US007559848B2

(12) United States Patent
Nickel

(10) Patent No.: US 7,559,848 B2
(45) Date of Patent: Jul. 14, 2009

(54) GOLF CLUB

(76) Inventor: Werner Nickel, Narrenbergstrasse 5, Keltern (DE) D-75210

( * ) Notice: Subject to any disclaimer, the term of this patent is extended or adjusted under 35 U.S.C. 154(b) by 0 days.

(21) Appl. No.: 11/695,215

(22) Filed: Apr. 2, 2007

(65) Prior Publication Data

US 2007/0191131 A1 Aug. 16, 2007

Related U.S. Application Data

(63) Continuation-in-part of application No. PCT/EP2005/010391, filed on Sep. 27, 2005.

(51) Int. Cl.
*A63B 47/02* (2006.01)
*A63B 53/04* (2006.01)

(52) U.S. Cl. ..... 473/286; 294/19.2

(58) Field of Classification Search ..... 473/286; 294/19.2

See application file for complete search history.

(56) References Cited

U.S. PATENT DOCUMENTS 4,248,430 A 2/1981 Kepler
5,102,139 A 4/1992 Greig
5,417,426 A 5/1995 Bayer
2002/0022539 A1 2/2002 Smith et al.
2002/0147055 A1 10/2002 French

OTHER PUBLICATIONS

International Search Report; PCT/EP2005/010391; Dec. 23, 2005.

*Primary Examiner*—Stephen L. Blau
(74) *Attorney, Agent, or Firm*—Cantor Colburn, LLP

(57) ABSTRACT

A golf club has a device for the alternate picking up and simultaneous placing down of a marker on the green or respectively the placing down of a golf ball through the intermediary of a mechanical pivotal mechanism, wherein both the picking up of the ball and the simultaneous placing of the marker as well as the placing of the ball and the picking up of the marker from the green is effected by the player whilst in a substantially standing position. By the mechanical pivotal mechanism being formed by a pivotally mounted rocker for the alternate picking up of ball and marker and the picking up and placing down of the marker being effected in a guided manner, the ball is picked up and the marker simultaneous placed down or respectively the ball is placed and the marker picked up in a correct manner without the player needing to bend down.

24 Claims, 4 Drawing Sheets

GOLF CLUB

CROSS REFERENCE TO RELATED APPLICATIONS

This application is a continuation in part of PCT application PCT/EP 2005/010391, filed on Sep. 27, 2005, the entire contents of which are incorporated by reference herein. This application is also related to and claims the priority of German Patent Application 10 2004 048 073.7, filed on Feb. 10, 2004, and of U.S. Provisional Patent Application No. 60/639,160, filed on Dec. 22, 2004, the entire contents of which are incorporated by reference herein.

TECHNICAL FIELD OF THE INVENTION

The present invention relates to a golf club as well as to an associated ball marker.

BRIEF DISCUSSION OF THE RELATED ART

In the game of golf, one player regularly has to pick his golf ball up from the green whilst another player is playing his ball. At this time, a marker is placed behind the ball on the green. When it is the first player's turn to play his shot, he picks up the marker and replaces his golf ball on the original spot. Golf balls have to be picked up at the end of every hole and on different greens throughout the golf course and this can be difficult for older players or for those who are no longer as supple as they once were, as they have to bend forwards and pick up the golf ball or respectively the marker. The resultant problem has been around for a long time, which means that the state of the art already provides some solutions to this problem.

U.S. patent application Ser. No. 2002/0022539 A1, especially FIGS. 3 to 6, makes known a mechanical solution comprising a plurality of interacting pivotal arms, the mechanical solution being disposed on the handle of the putter. When a picking up opening in the golf putter is pressed over the ball, on the one hand the ball is secured in the putter and, on the other hand and at the same time, a magnetically held marker is released by means of the levers of the pivotal arms. However, the release of the marker leads to inaccuracies that can be manipulated and are consequently not in accordance with golf rules and this is made worse by the fact that, from the viewpoint of the player, the position of the marker can only be guessed at when a ball is picked up. In the reverse direction, the ball has to be released, however, in the case of the said mechanical exemplified embodiment, there is no explanation as to how this occurs and/or how the marker is to be picked up. The arrangement on the handle not only makes it difficult to manipulate when picking up the ball, it also created difficulties when stowing the golf club back into the golf bag as the golf club can catch on the other golf clubs.

Even more inaccurate are the release mechanisms in the case of the solution according to U.S. Pat. Nos. 5, 417,426, 5,102,139, 4,248,430 or to U.S. application No. 2002/0147055 A1, as in all cases there is no guiding of the marker and, in the majority of cases, no simultaneousness with the placing of the marker and the picking up of the ball. These solutions do not work in the reverse direction if the marker is to be picked up and the ball placed back in its original position.

BRIEF SUMMARY OF THE INVENTION

The invention is based on correctly picking up the ball and at the same time placing down the marker or respectively placing down the ball and picking up the marker without the player having to bend down.

This is achieved by means of a golf club and ball marker used together with the golf club, both having features as claimed and described herein.

Using the modified golf club or respectively golf putter, a player can pick the ball up off the green and at the same time mark it whilst in the standing position. This procedure is carried out using the club head or respectively the putter head. A big advantage is that as the game progresses, the procedure is carried out in the reverse order, that-is-to-say, preferably from the standing position the placed marker can be removed through the intermediary of the club head or respectively the putter head once the ball has first been replaced into its original position. Manipulations, with reference to the distance between the ball and the marker, or the ball and the hole, are obviated to the greatest possible extent as the marker is forcibly guided preferably both when being placed and when being picked up.

Further advantages are produced from the sub claims and the subsequent description.

BRIEF DESCRIPTION OF THE DRAWINGS

The invention is described in detail in the enclosed diagrams. The details can be altered/improved by means of modifications without the sense and purpose of the invention being altered. The Figures are as follows.

DETAILED DESCRIPTION OF THE INVENTION

The invention is now described in more detail as an example with reference to the enclosed drawings. However, the exemplified embodiments are only examples that are not to restrict the inventive concept to a specific disposition.

Before the invention is described in detail, it must be pointed out that it is not restricted to the respective components of the golf club or to the explained method of operation as the said components and method can vary. The terms used in this case are simply determined to describe particular specific embodiments and are not used in a restrictive manner. If, in the description and in the claims, the singular or unspecific articles are used, this also refers to the multiple of these said elements in so far as the overall context does not clearly make the contrary applicable. The same is applicable in the reverse direction.

Figure 2:
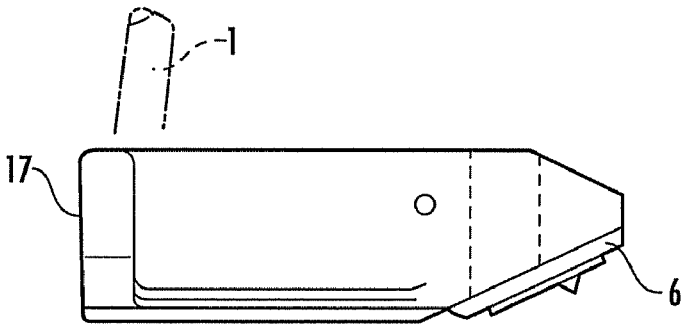
FIG. 2 is a side view of the golf club.
Figure 1:
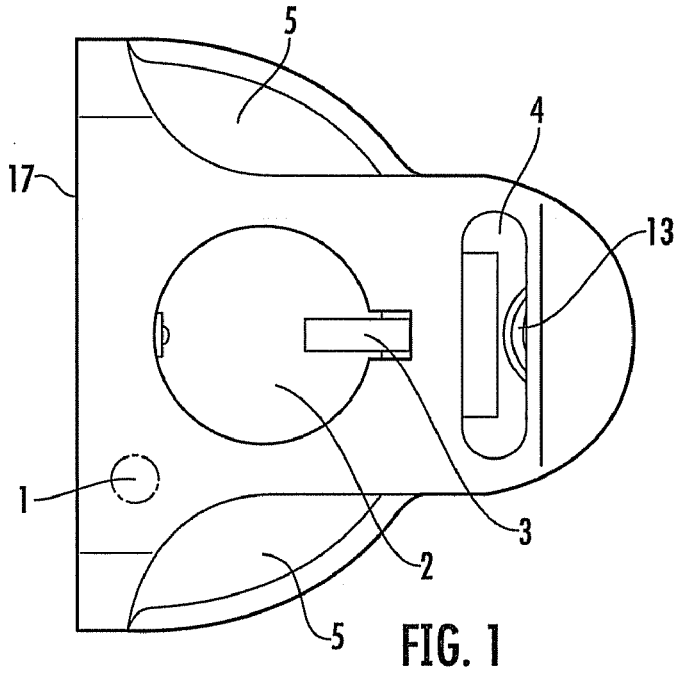
FIG. 1 is a top view of the golf club.

The Figures show a putter, it also being possible for the invention to be provided on another golf club. FIG. 1 shows a top view of the golf club, preferably the putter. The choice of material, as well as the exterior design and the mounting of the shaft 1 are not objects of the invention. FIG. 1 shows the cylindrical opening 2 that is open upwards and is for picking up the golf ball, and the rocker 3 in the "one finger" design. The sole 5 of the club or respectively of the putter that widens outwards is for picking the ball up off the green without placing down the marker 13. The rear recess 4 that is preferably round or oval, that is in the form of a peephole, makes it possible for the deposited marker to be seen when the golf ball 18 is returned. This means that it is easier to find and position the marker that is situated on the green. According to FIG. 2, a side view of the putter, the rear sole 6 of the club or respectively of the putter can be inclined upwards in a function-orientated manner, details of which can be found below.

Figure 3:
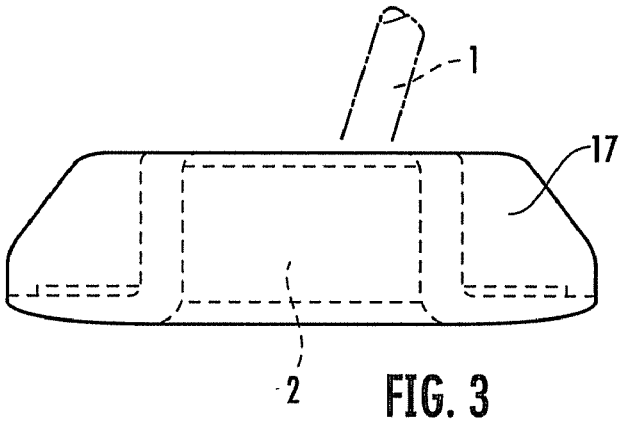
FIG. 3 is a view onto the hitting face of the golf club.
Figure 4:
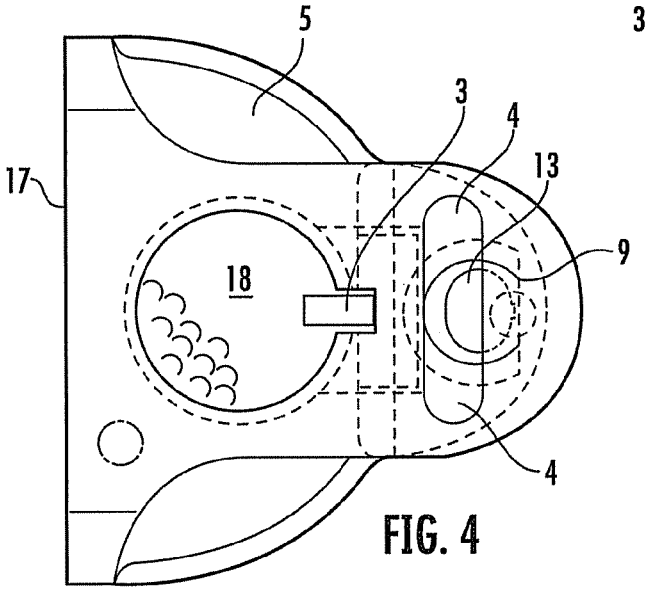
FIG. 4 is a top view of the golf club with the golf ball having been picked up, FIG. 5, 6 are sections through the center of the golf club directly before and after the ball has been picked up.
Figure 5:
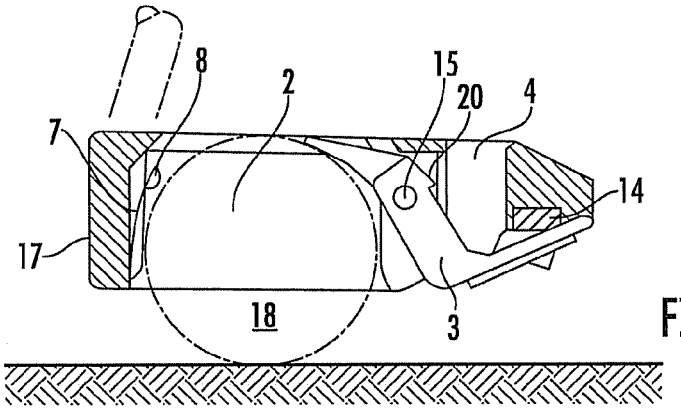

FIG. 3 is a view of the hitting face 17 of the putter. FIG. 4 is a top view of the putter with the golf ball 18 having been picked up. A section through the center of the putter, as in FIG. 5, shows the mechanism in the initial position shortly before the ball is picked up with the cylindrical opening that is mounted in the center and is for accommodating the ball. The opening 2 is conically tapered on the top side of the putter for the defined limiting of the accommodating of the golf ball. The diameter of the opening is larger than that of a normal golf ball. This means that "magnum" golf balls can also be picked up.

Figure 7:
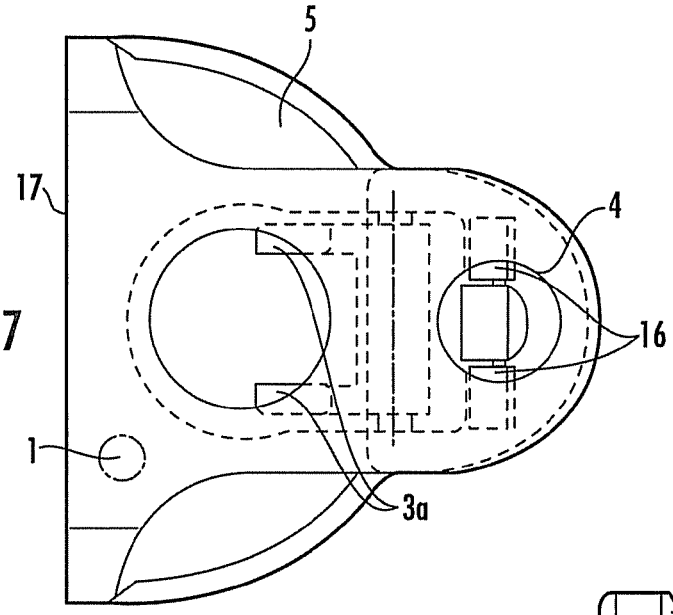
FIG. 7 is a top view in the normal position, that-is-to-say without a golf ball, of an additional embodiment with a two-arm rocker, FIG. 8, 9 are representations as in FIGS. 5 and 6 of the additional embodiment.
Figure 8:
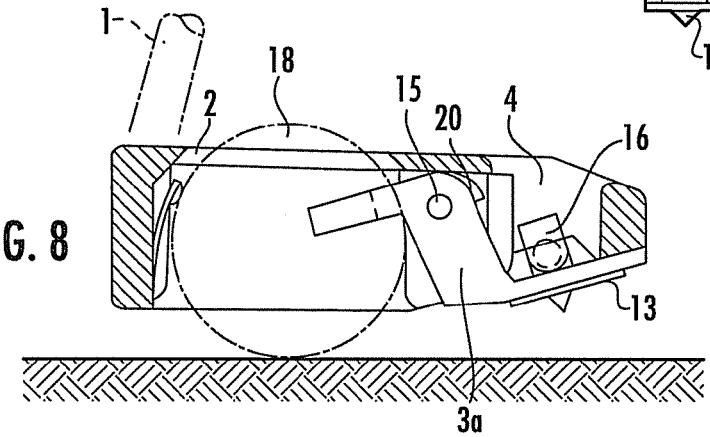

The rocker 3 represents one element of the invention. It is simply designed and can be produced in the form of a molded part produced from different materials (for example metal or plastics material). The rocker is mounted so as to pivot about a pivotal axis 15 that is formed preferably by at least one bolt and provides the functional connection between golf ball 18 and marker 13. The rocker 3 or respectively the axis of rotation is preferably mounted at the pivot points by means of two spring-loaded spherical elements. This means that it can easily be removed from the golf putter manually, without the need for any tools, by overcoming the spring force of the said spring-loaded spherical elements. The rocker can be in the form of a one-arm rocker 3 or a two-arm rocker 3*a* (FIG. 7). The side facing the golf ball is adapted to the form of the golf ball 18. The other side of the rocker is for picking up and securing the marker 13. This latter is retained in the putter head, either by means of a frictional-locking connection (FIG. 5) or a positive-locking connection, such as, for example, tensioning elements 16 (FIG. 8). The marker, in its turn, secures the rocker 3 or respectively 3*a* in the normal position, that-is-to-say not having picked up a ball.

FIG. 5 also shows the spring element 7 with the mounted rivet head 8 in the relieved position. It is the job of the spring element 7 to press the golf ball 18, that has been picked up, against the rocker 3 by means of the spring force generated. The rivet head 8, in this case, provides a positive-locking connection with the scale-shaped recesses of the golf ball. This means that the golf ball is prevented from falling out of the putter when the ball is picked up. It is possible to use spring-loaded spherical elements 7*a* (FIG. 12) or other locking elements in place of the spring element 7 and they can also be accommodated in the rocker 3. In principle, additional embodiments that are familiar to the man skilled in the art are also conceivable in so far as it can be guaranteed that the ball is secured in the putter at times.

FIG. 5 shows the rocker 3, in this exemplified embodiment held by means of a magnet, in the normal position. The magnet 14 acts on the marker, which, in its turn, secures the rocker between the marker and the putter. A particular feature is that the arm of the rocker 3 does not project above the top of the putter in this position.

Figure 6:
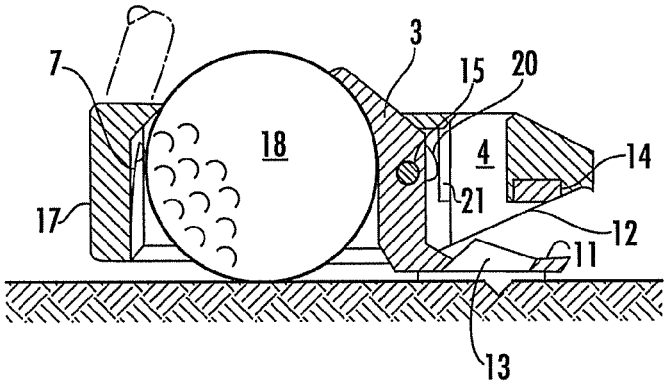

Picking up a golf ball:

When a ball is being picked up, the putter is guided over the golf ball. This is effected single-handedly and with the player in the upright position. By means of the player exerting light pressure onto the putter, the golf ball is pressed against the rocker 3 or respectively 3*a* and the spring element 7 or respectively the spring-loaded spherical element 7*a*. This has the effect of moving the rocker and releasing the marker 13 from its holding means. As the ball-picking-up movement progresses, the marker is moved in a positive locking manner, or respectively preferably as a consequence of additional ball notch bolts, such as, for example, the tensioning element 16 (FIG. 11), in a frictional locking and a positive locking manner, in and by the rocker 3 to the green and is pressed onto the said green. The arm of the rocker associated with the marker is almost in alignment with the sole 5 of the putter in this position. Ball 18, spring element 7 or respectively spring-loaded element 7*a* and rocker 3 remain in their position on account of the golf ball that has been picked up, even if the putter is lifted up in a vertical manner. The marker 13 itself remains behind positioned on the green. Where required, a forced guiding movement can be provided for the marker. FIG. 6 shows the ball that has been picked up, the tensioned spring element 7 and the rocker 3 in the holding and marking position, that-is-to-say after the ball has been picked up and the marker 13 deposited.

FIG. 7 is also a top view in the normal position, that is without a golf ball, of an additional embodiment with a "two-arm" rocker 3*a*. This view shows the two tensioning elements 16 with spring-loaded spheres. In addition, it is possible to see the recess 4, through which the marker 13 can be steered.

Figure 11:
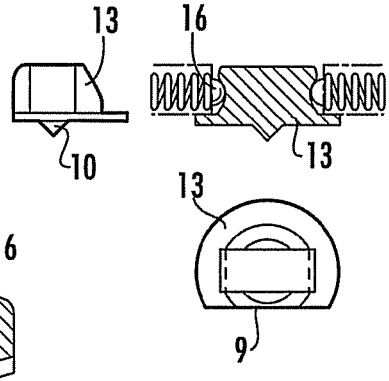
FIG. 11 is a marker developed specially with ball locking bolts for holding purposes.
Figure 9:
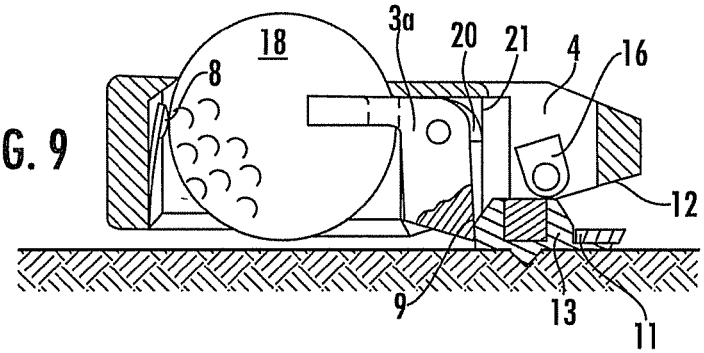

FIGS. 8 and 9 are substantially identical to FIGS. 5 and 6 except for the two-arm rocker. In addition, the marker 13, as shown in an enlarged view in FIG. 11, is retained by two spring-loaded spheres or ball notch bolts. FIG. 9 illustrates that once the ball has been picked up, the two rocker arms are in a horizontal position. In the case of this variant, they do not protrude beyond the top of the putter, contrary to the single arm rocker in FIG. 6

Placing the golf ball back on the green:

When the ball is being replaced, the player, using just one hand and standing in an upright position, moves the head of the putter, which contains the golf ball 18, over the marker that is situated on the green in such a manner that the recess 11 (FIGS. 6, 9) in the rocker 3, 3*a* centers on the marker 13. The finding of the marker and the positioning of the recess 11 over the marker is facilitated in a substantial manner by the recess 4 (FIGS. 6 and 9) that is configured as a peephole.

By pivoting the putter head lightly to the side in the direction of the inclination 12 (FIG. 6) through the intermediary of the shaft 1, the golf ball 18 is pressed out of its holding position. As the ball-depositing-movement progresses, the marker 13, at the same time, moves towards its holding position until it is locked. The putter can then be removed upwards. The ball stays in its original putting position and can be putted. As the procedure develops in an inevitable manner, it is not possible to manipulate the golf ball when the ball is being deposited!

Figure 13:
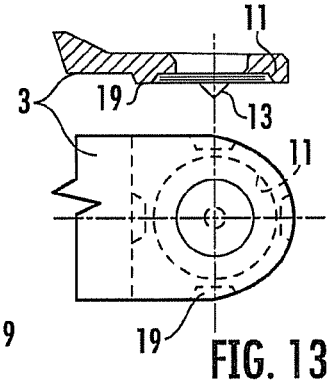
FIG. 13 is another alternative for the securing of a marker to the rocker.
Figure 10:
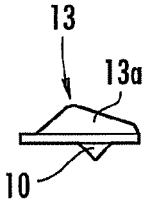
FIG. 10 is a side view and top view of a marker.
Figure 10:
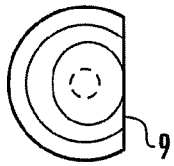

FIG. 10 shows the marker, which has been developed specially to be held by the magnet 14. By means of the straight flat surface 9, which intersects a part of the picking up sphere, the marker 13 is prevented from being removed from the putter again by its top side 13*a* in a wrong position that is consequently not in accordance with golf rules. The tip 10 that is mounted on the bottom gives the marker better holding and better securement on the green. The marker in FIG. 10 is developed to be retained by means of a magnet, the marker in FIG. 11 is developed to be retained by means of spring-loaded spheres, such as the tensioning element 16. FIG. 13 shows an additional alternative for the securing of a marker on the rocker 3. The flat marker is secured and accommodated centrally on the outside diameter. The centering is effected by means of integral formations 19 that are disposed on the periphery of the recess 11. The spring element in FIG. 5 has a relatively large travel stroke and is for holding the golf ball and for bridging the different golf ball diameters.

Figure 12:
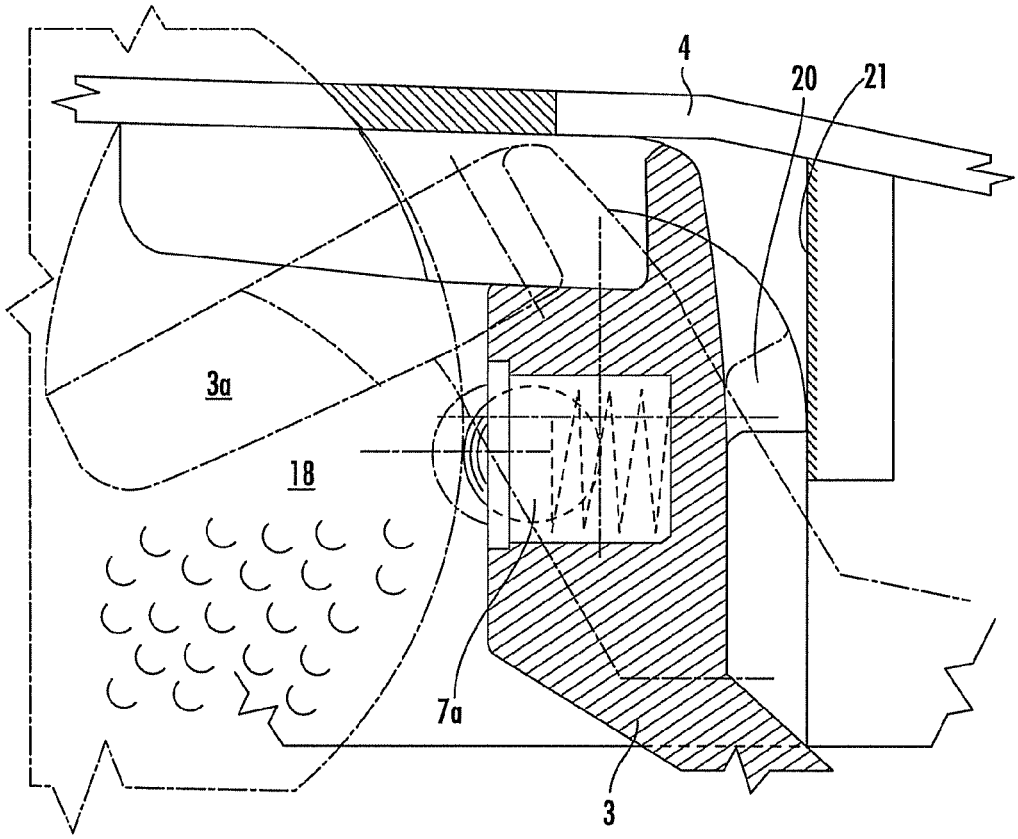
FIG. 12 is an enlarged cutout of the rocker in the region of the bearing arrangement of the golf ball with a golf ball that has been picked up.

FIG. 12 is an enlarged cutout of the rocker 3 in the region of the bearing arrangement of the golf ball 18 where a golf ball has been picked up. In this case, it is possible to see the at least one contact face 20 with which the rocker 3 abuts against a wall 21 of the club housing, or respectively putter housing, when a ball has been picked up. In the position that is shown by the dot-dash line, the marker 13 has been picked up and the contact face does not abut against the Wall 21. The contact face 20 preferably has a curved shape such that as the rocker 3 is pivoted further inwards as a result of the golf ball 18 being picked up, there is an increasing frictional connection between the rocker and the club housing, which is represented by the continuous line. This creates a braking effect with regard to the pivotal movement of the rocker 3 with the result that the rocker, when centering and picking up the marker 13, does not move in an undesired manner and consequently holds the ball reliably and does not release it uncontrollably.

FIG. 12 also shows the spring-loaded spherical element 7*a* as an alternative to the spring element 7 used to hold the golf ball 18 when it has been picked up. The spring-loaded spherical element 7*a* is accommodated in the displaceable rocker 3 and comprises spherical elements that are disposed at one point, preferably at two points.

Using this device, it is possible to pick up or respectively place down the golf ball and place down or respectively pick up the marker from the green in accordance with the applicable rules of golf. On one hand, the marker is guided when it is being put down such that it is possible to put it down again in a reproducible manner. On the other hand, where required, the marker is placed down behind the ball when viewed from the hole in accordance with the rules of golf. Where the golf club is used, in accordance with the rules of golf, the marker is first placed in position before the ball can be removed from the green using the putter. When the ball is being replaced, the ball is first brought into position on the green, in dependence on the position of the marker, before the marker is removed. The picking-up-position corresponds precisely to the placing-down-position of the marker such that any manipulating of the position of the golf ball that has been compulsorily replaced with reference to the putting hole is excluded to the greatest possible extent. In addition, where required, the rocker 3 can be removed from the putter for competitions.

It is obvious that this description can be subject to the most varied of modifications, amendments and adaptations, which are considered as equivalents to the attached claims.

The invention claimed is:

1. Golf club comprising:

a device for the alternate picking up and the simultaneous placing down of a marker on the green or respectively the placing down of a golf ball through the intermediary of a mechanical pivotal mechanism, wherein both the picking up of the golf ball and the simultaneous placing of the marker as well as the placing of the golf ball and the simultaneous picking up of the marker from the green is effected by the player whilst in a substantially standing position, wherein the mechanical pivotal mechanism is formed by a pivotally mounted rocker for the alternate picking-up of golf ball and marker, wherein the marker is guided for the picking up and placing movements, such that, when picking up the marker from the green, it is possible to actuate the rocker by pivoting a club shaft of the golf club gently in a rearward and inclined manner whilst at the same time pressing the golf club on the green and thereby moving the rocker, the golf ball that is held in the golf club being released and the marker moved into its holding position.

2. Golf club according to claim 1, wherein the golf club is a fully useable putter for putting.

3. Golf club according to claim 1, wherein the golf club comprises a club head and an opening is provided in the club head for picking up and securing a golf ball, the opening being cylindrical and larger than a regulation golf ball.

4. Golf club according to claim 1, wherein at least one spring element is provided with a rivet-head-like elevation for securing the golf ball.

5. Golf club according to claim 4, wherein the elevation interacts with scale-like recesses of the golf ball for securing purposes.

6. Golf club according to claim 1, wherein at least one spring-loaded spherical element is provided for securing the golf ball.

7. Golf club according to claim 1, wherein the rocker, in the form of a multi-function rocker, comprises at least one arm.

8. Golf club according to claim 7, wherein the at least one arm is developed such that, in the hitting position, it lies under a top side of a club head of the golf club and does not protrude upwards.

9. Golf club according to claim 1, wherein, in a position in which the golf club picks up the golf ball, a lever of the rocker, associated with the marker, guides the marker to the green.

10. Golf club according to claim 1, wherein, in a position in which the golf club picks up the golf ball, a lever of the rocker, associated with the marker, is aligned with a sole of the golf club.

11. Golf club according to claim 1, wherein, in a position in which the golf club picks up the golf ball, a lever of the rocker, associated with the marker, is at a spacing from an inclination, on which the rocker is secured by the marker not having picked up a golf ball.

12. Golf club according to claim 1, wherein a rear portion of the rocker, when viewed from a hitting face of the golf club, is for handling the marker.

13. Golf club according to claim 12, wherein the rear portion is a rear lever of the rocker carrying out a controlled compulsory movement of the marker from its holding position to the green and from the green back to its holding position.

14. Golf club according to claim 1, wherein the rocker (3, 3*a*) comprises a marker picking up means provided with a cone-shaped recess to facilitate the introduction and positioning of the marker when it is picked up from the green.

15. Golf club according to claim 1, wherein the rocker (3, 3*a*) comprises a marker picking up means comprising integral formations disposed centrally on a periphery of a recess.

16. Golf club according to claim 1, wherein due to the marker being secured in the rocker and due to a flattened, straight face on the marker, it is only possible to pick up the marker that is located on the green if the golf club is in a certain position.

17. Golf club according to claim 16, wherein a positive locking connection between a marker picking up means and the marker is developed in such a manner that a twisting of the marker in the marker picking up means is prevented.

18. Golf club according to claim 17, wherein the twisting of the marker is prevented by at least one straight face.

19. Golf club according to claim 1, wherein the rocker comprises a marker picking up means and wherein the rocker in a region of the marker picking up means has approximately the same width as the golf club at this position.

20. Golf club according to claim 1, wherein the rocker comprises at least one contact face, which abuts against a wall of a club housing of the golf club when the golf ball is picked up.

21. Golf club according to claim 20, wherein the at least one contact face has a curved form such that, as the rocker is pivoted in, the at least one contact face and the wall abut against each other in an increasingly frictionally locked manner.

22. Golf club according to claim 1, wherein the rocker is designed such that the rocker and the marker are received into a sole of the golf club when the marker is in a holding position.

23. Golf club according to claim 1, wherein on a back of the golf club a round or oval recess is provided as a peephole for finding and aiming at the marker that is located on the green.

24. Golf club according to claim 1, wherein a sole of the golf club is inclined at its back approximately 20-30° for tilting the golf club to a side when depositing the golf ball and at the same time picking up the marker.

* * * * *